United States Patent [19]

Jones

[11] Patent Number: 4,706,304

[45] Date of Patent: Nov. 17, 1987

[54] TUBULAR GARMENT

[76] Inventor: David J. Jones, 3221 Basin, Cheyenne, Wyo. 82009

[21] Appl. No.: 926,097

[22] Filed: Nov. 3, 1986

[51] Int. Cl.[4] ..... A41D 23/00

[52] U.S. Cl. ..... 2/91

[58] Field of Search ..... 2/91, 16, 59, 84

[56] References Cited

U.S. PATENT DOCUMENTS

| | | | |
|---|---|---|---|
| 1,157,341 | 10/1915 | Tallerday | 2/91 |
| 1,285,917 | 11/1918 | Bradley et al. | 2/91 |
| 3,160,892 | 12/1964 | Semons | 2/91 |

*Primary Examiner*—Doris L. Troutman

*Attorney, Agent, or Firm*—Dean P. Edmundson

[57] ABSTRACT

An elongated, tubular, flexible garment is described which has open ends and a longitudinal centrally located opening in the wall of the tubular garment. The garment is adapted to fit over the arms and across the shoulders of a person wearing the garment. If desired, elastic cuff members may be included on the open ends of the tubular garment. The garment is adapted to keep a person's arms warm without restricting movement of the arms in any way. The garment is useful in various sporting activities (e.g., golfing, skiing, exercising, etc.) or working activity where free arm movement is required.

9 Claims, 6 Drawing Figures

TUBULAR GARMENT

FIELD OF THE INVENTION

This invention relates to wearing apparel. More particularly, this invention relates to wearing apparel for sports or working activity. Even more particularly, this invention relates to apparel for a person's arms.

BACKGROUND OF THE INVENTION

The human body is so structured and biomedically programmed that, when the temperature of the body starts to fall, the majority of blood will be pumped to the vital organs in the torso, and to the brain, to keep the life support system running at the proper temperature. Blood supply to the limbs will be constricted, and the first sensation of 'being cold' will be felt in feet, arms and legs, though not necessarily in that order. It is then natural to put on a coat with sleeves, gloves, heavier socks, or overpants to stay warmer. But in many cases, coats with sleeves have the effect of both restricting movement and overheating the torso area, causing it to perspire.

Various types of wearing apparel, other than conventional coats and vests, are described, for example, in the following patents:

U S. Pat. No. 2,585,686—Rossant
U.S. Pat. No. 3,605,121—Suzuki
U.S. Pat. No. 4,321,709—Steinberg
U.S. Pat. No. 4,404,688—Knight
U.S. Pat. No. 4,520,510—Daigle
U.S. Pat. No. D. 121,135—Wittl
British Pat. No. 827,231—Dresner
British Pat. No. 848,169—Cisco
German Pat. No. 859,283—Kirchhoff
German Pat. No. 860,336—Dorbecker
French Pat. No. 1,044,184—Vendeville
French Pat. No. 1,055,414—Aeschbach However, none of such prior patents address the problems solved by the garment of the present invention.

SUMMARY OF THE PRESENT INVENTION

In accordance with the present invention there is provided an elongated, tubular, flexible garment having open ends. The tubular garment includes a centrally located longitudinal opening in the wall. This garment is adapted to fit over the arms and across the shoulders of a person wearing the garment. The garment of this invention may be made of any suitable material (such as wool, for example) and may also include thermal insulation. The free ends of the garment may also include elastic cuffs, if desired. In another embodiment the garment may include a hood. In yet another embodiment the garment may include a neck band for encircling the neck of the person wearing the garment.

The garment of the invention is especially useful and desirable for persons involved in various sporting or working activities who desire to keep their arms warm without restricting the mobility of the arms as required in the sporting or working activities. Thus, the garment of the invention is very beneficial for persons engaged in skiing, golfing, etc.

Other advantages will be apparent from the following detailed description.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
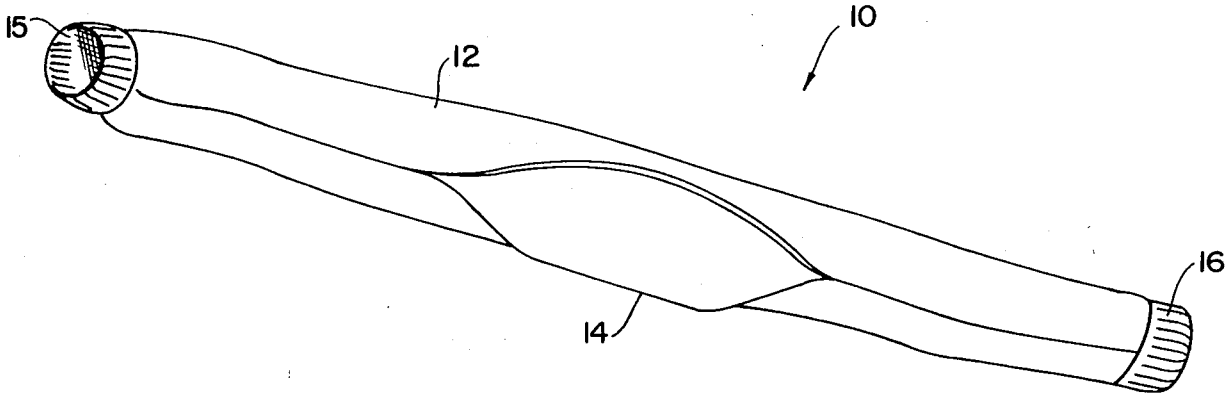
FIG. 1 is a perspective view of one embodiment of tubular garment of the invention.

In FIG. 1 there is shown a perspective view of one embodiment of tubular garment 10 of the invention which comprises an elongated tubular body member 12 made of a flexible cloth or cloth-like material. The ends of the garment are open, and the garment also includes a centrally located opening 14. Preferably the open ends of the tubular garment include cuffs 15 and 16, as illustrated. The cuffs may comprise an elastic material or they may include a strap or other such item which can be tightened around the wearer's wrist and then fastened in place (e.g. with a hook and loop fastener such as Velcro, or with a button, or snap, or zipper, etc.).

Figure 2B:
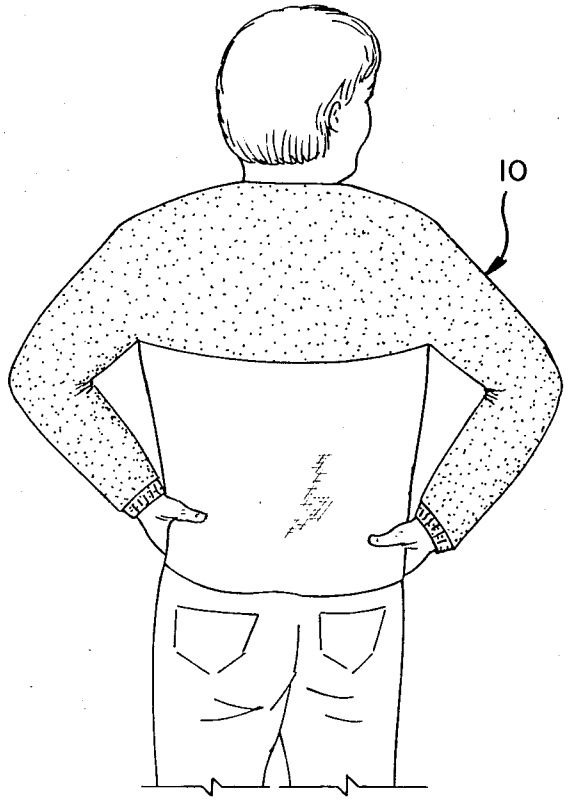
FIGS. 2A and 2B illustrate front and rear views of a person wearing a tubular garment of the invention.
Figure 2A:
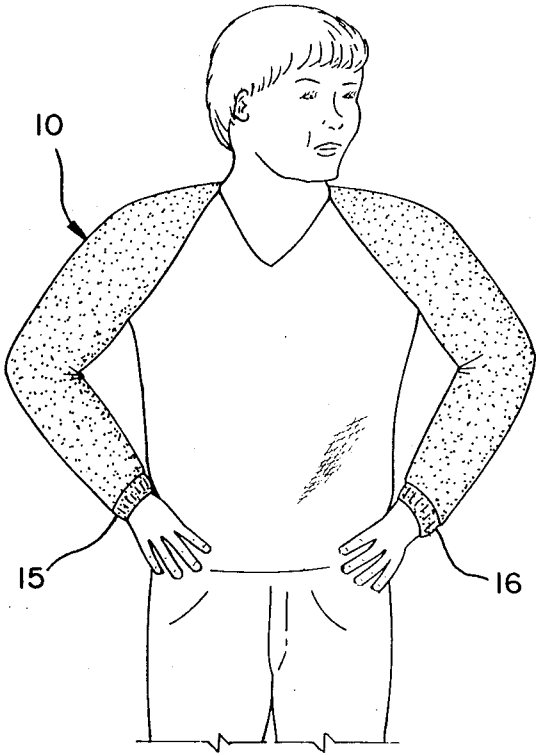

The tubular garment is intended to be worn over the arms and across the shoulders of the wearer (as illustrated in FIGS. 2A and 2B) to keep the arms warm without restricting free movement of the arms for sporting activities (e.g., skiing, golfing, tennis, etc) or for working activities or for exercising.

The tubular garment may be made in various sizes in order to accommodate persons of varying size and age. Generally speaking, the length of the garment may vary from about 30 to about 90 inches. The diameter may also vary, for example, from about 3 to about 12 inches, if desired. The diameter may be uniform along the length of the garment or it may be smaller at the ends and larger in the middle, if desired.

The central opening is sufficiently large to accommodate the width of the wearer's body. Generally speaking, the central opening has a length in the range of about 12 to 30 inches to accommodate persons of different sizes.

The garment may be made of various materials or combinations of materials. For example, it may be made of wool, cotton, leather, denim, synthetics (e.g., polyester, rayon, taslon, nylon, acrylic, nylon taffeta, polyurethane), etc. It may be knitted or woven. It may also include thermal insulation (e.g., down, or synthetic insulating material, foam), if desired. The arm portions of the garment may be made of one material and the central portion (which connects the two arm portions) may be composed of an entirely different material, if desired. The central portion may even be composed of straps or a strip of flexible material (e.g., cloth or leather).

Figure 3:
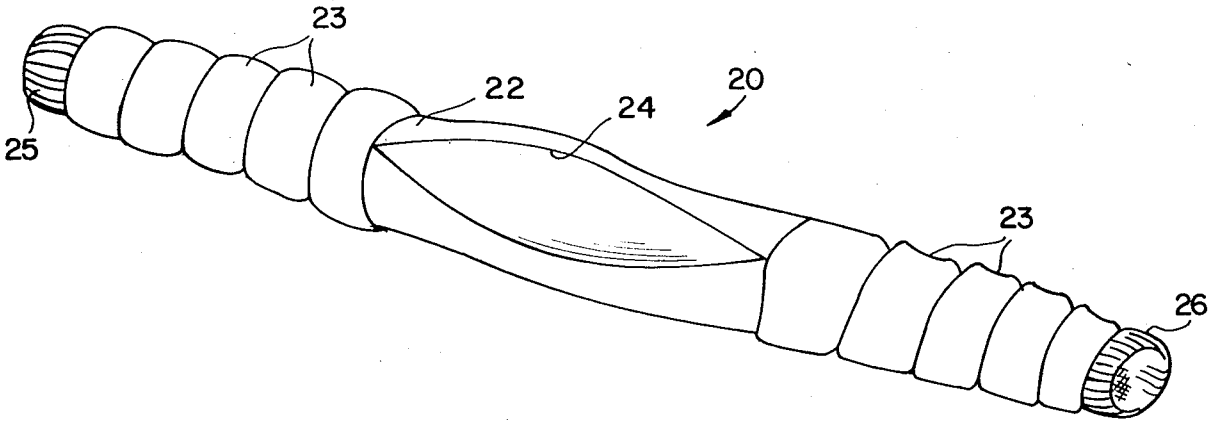
FIG. 3 is a perspective view of another embodiment of tubular garment of the invention.

FIG. 3 illustrates another embodiment of tubular garment 20 of the invention. In this embodiment there is a tubular member 22 in which the arm portions include pleated sections 23. The ends 25 and 26 are open and they include elastic cuffs. The central opening 24 is centrally located.

Figure 4:
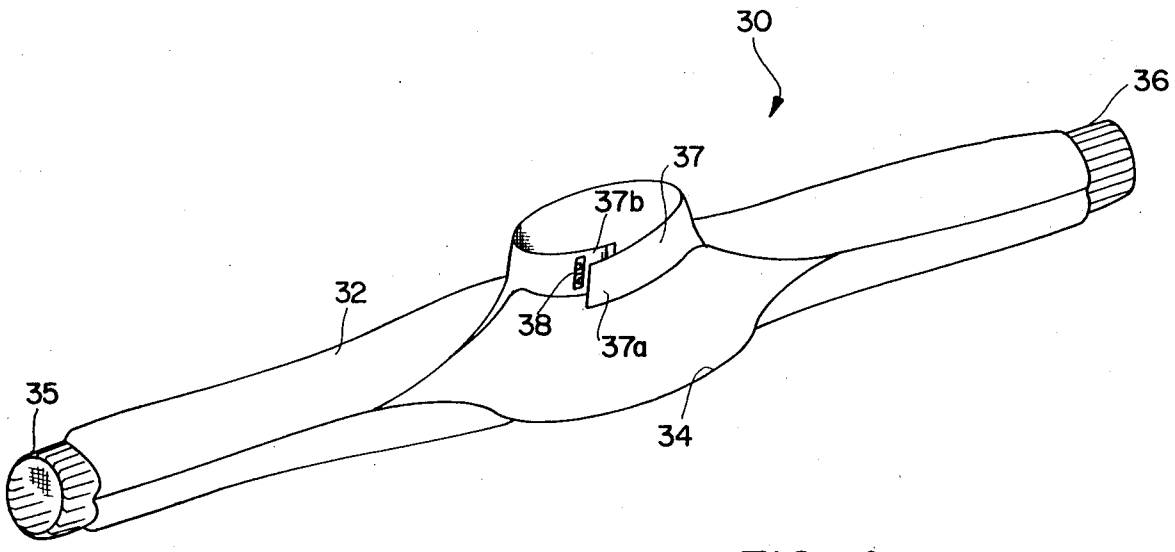
FIG. 4 is a perspective view of another embodiment of tubular garment of the invention.

FIG. 4 illustrates another embodiment of tubular garment 30 of the invention. The tubular member 32 includes open ends and cuffs 35 and 36. It also includes central opening 34. This embodiment also includes a neck band 37 which is adapted to surround or encircle the neck of the person wearing the garment. If desired, the neck band may be openable (as illustrated), where the ends 37*a* and 37*b* are connected together by means of a fastener such as a hook and loop fastener 38 (e.g., Velcro), or a snap, or a button, etc.

Figure 5:
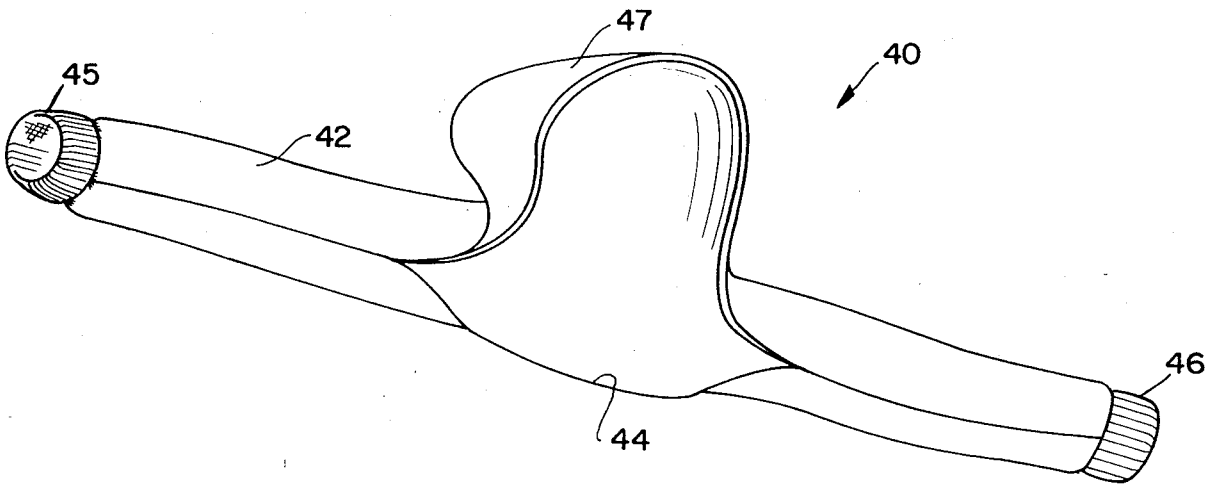
FIG. 5 is a perspective view of yet another embodiment of tubular garment of the invention.

FIG. 5 illustrates yet another embodiment of tubular garment 40 which includes tubular member 42 having open ends 45 and 46. This embodiment also includes a central opening 44 and a hood member 47 as an integral part of the tubular member. The hood may also be made of cloth or cloth-like material.

Other variants are possible without departing from the scope of the present invention. For example, the garment may be worn as a scarf or a muffler by wrapping it around the neck of the wearer.

What is claimed is:

1. An elongated, tubular, flexible garment having a length in the range of about 30 to 90 inches and a diameter in the range of about 3 to 12 inches, wherein the ends of said garment are open, wherein said garment includes a wall having a centrally located longitudinal opening therein, said opening having a length in the range of about 12 to 30 inches; wherein said garment is adapted to fit over the arms and across the shoulders of a person wearing said garment; and wherein said garment further includes a flexible hood member attached to said garment adjacent said longitudinal opening.

2. An elongated garment in accordance with claim 1, wherein said garment comprises wool.

3. An elongated garment in accordance with claim 1, wherein said garment is knitted.

4. An elongated garment in accordance with claim 1, wherein each said end of said garment includes an elastic cuff member.

5. An elongated garment in accordance with claim 1, wherein said garment includes thermal insulation material.

6. An elongated, tubular, flexible cloth garment having open ends; wherein said garment includes a centrally located longitudinal opening in a wall thereof, said opening having a length in the range of about 12 to 30 inches; wherein said garment is adapted to fit over the arms and across the shoulders of a person wearing said garment; and wherein said garment further includes a neck band attached to said garment adjacent said longitudinal opening, wherein said neck band is adapted to encircle the neck of said person.

7. An elongated garment in accordance with claim 6, wherein said garment comprises wool.

8. An elongated garment in accordance with claim 6, wherein each said end of said garment includes an elastic cuff member.

9. An elongated garment in accordance with claim 6, wherein said garment includes thermal insulation.

* * * * *